US005555569A

United States Patent [19]

Lane

[11] Patent Number: 5,555,569

[45] Date of Patent: Sep. 17, 1996

[54] HELMET AND FACE MASK INTERFACE SYSTEM

[75] Inventor: Abbott A. Lane, Dayton, Ohio

[73] Assignee: Firequip Helmets, Inc., Dayton, Ohio

[21] Appl. No.: 210,707

[22] Filed: Mar. 18, 1994

[51] Int. Cl.[6] ..... A42B 3/18; A62B 18/00

[52] U.S. Cl. ..... 2/424; 2/5; 2/416; 2/421; 128/201.22; 128/207.11

[58] Field of Search ..... 2/410, 5, 6.1, 6.2, 2/7, 8, 411, 416, 421, 422, 424, 15, 10, 9; 128/201.22, 201.23, 206.12, 206.21, 206.27, 206.28, 207.11, 201.24

[56] References Cited

U.S. PATENT DOCUMENTS

| | | | |
|---|---|---|---|
| 2,867,812 | 1/1959 | Roth et al. | 2/6.2 |
| 3,035,573 | 5/1962 | Morton, Jr. et al. | 2/6.2 |
| 3,258,010 | 6/1966 | Austin et al. . | |
| 3,513,841 | 5/1970 | Seeler | 128/201.23 |
| 3,599,635 | 8/1971 | Ansite | 128/207.11 |
| 3,624,663 | 11/1971 | Jones | 2/424 |
| 4,286,339 | 9/1981 | Coombs | 2/414 |
| 4,397,045 | 8/1983 | Schonwetter et al. | 2/5 |
| 4,734,940 | 4/1988 | Galet et al. | 2/422 |
| 4,766,609 | 8/1988 | Lane | 2/5 |
| 5,069,205 | 12/1991 | Urso | 128/207.11 |
| 5,121,508 | 6/1992 | Grilliot et al. | 2/421 |
| 5,291,880 | 3/1994 | Almovist | 128/201.22 |

FOREIGN PATENT DOCUMENTS

| | | | |
|---|---|---|---|
| 2532552 | 3/1984 | France | 2/411 |
| 826198 | 12/1959 | United Kingdom | 128/207.11 |
| 2268388 | 1/1994 | United Kingdom | 2/422 |

*Primary Examiner*—Michael A. Neas
*Attorney, Agent, or Firm*—Thompson Hine & Flory P.L.L.

[57] ABSTRACT

A safety helmet and face mask system having an interface for suspending both the helmet and the face mask on a wearer's head by a single support web, thereby eliminating the need for separate support assemblies. The system includes a helmet having a shell and liner, hooks attached to opposite sides of the liner, and a face mask having a pair of O-rings slidably mounted on straps attached at upper and lower points on opposite sides of the mask. The O-rings releasably engage the hooks on the helmet liner to integrally interconnect the helmet and liner. Buckles are located on the sides of the mask so that the effective lengths of the straps between points of connection to the mask can be varied to draw the mask and helmet together and seat the helmet and mask properly on the wearer's head. The interface provides both horizontal and vertical support for the mask by a single strap on each side of the mask.

29 Claims, 5 Drawing Sheets

HELMET AND FACE MASK INTERFACE SYSTEM

BACKGROUND OF THE INVENTION

The present invention relates to a head gear for use in hazardous environments, and more particularly, to a safety helmet and face mask interface.

In hazardous environments, such as are encountered by firefighters, protection is needed not only from head impacts, but also from breathing hazards such as smoke and noxious fumes. In order to be protected from both hazards, it is necessary to wear a breathing mask, which is part of a self-contained breathing apparatus ("SCBA") system in combination with a safety helmet. With conventional equipment, in order to wear both a helmet and an SCBA mask, the wearer must first put the support strap webbing for the face mask over his head, properly position the mask against his face to seat it, and then adjust the straps for an air-tight fit. Next, the wearer dons his safety helmet, and by doing so, covers the mask webbing with the suspension webbing of support straps for the safety helmet. Consequently, with this arrangement two separate strap assemblies cover the wearer's head, which may be uncomfortable for the wearer. Further, with this arrangement the face mask cannot be removed without first removing the helmet. This can be tedious and potentially hazardous, in that the face mask may need to be removed while the wearer is still in a hazardous environment and exposed to a risk of head injury.

Accordingly, there is a need for a safety helmet and face mask system which eliminates the need for overlapping layers of webbing, and which provides for easy removal of the face mask without the inconvenience of also having to remove the helmet.

SUMMARY OF THE INVENTION

The present invention is a safety helmet and face mask interface system in which the face mask is removably coupled directly to the helmet. The helmet preferably is of a type having a hard outer shell and a liner enclosed in the shell for suspending the helmet on the wearer's head. The face mask is preferably of a type having a transparent plastic face panel shaped to engage the face of the wearer.

The helmet and face mask are integrally interconnected by a pair of connectors which extend and attach to the helmet liner and releasably engage a pair of complementary connectors retained on straps attached to the sides of the mask. In a preferred embodiment, the connectors are hooks which extend downwardly from the helmet liner and engage O-rings slidably mounted on the straps on the mask. An advantage of the present invention over prior art systems is that both horizontal and vertical support for the mask is provided with a single strap on each side of the mask.

Specifically, each of the straps is attached at one end to the top portion of the mask, and is looped through a buckle which is attached to the lower portion of the mask. Consequently, the segments of strap extending from the O-rings to the top portion supports the mask horizontally, and the segments of strap extending from the O-rings to the lower portion supports the mask vertically.

Each strap is of sufficient length to pass through and extend beyond the buckle, having a dangling end segment. The buckle permits the length of the strap extending between the top attachment point and the buckle to be altered, and by pulling on the end segments of the straps, the wearer can tighten the straps and thereby adjust the force exerted by the straps to hold the helmet on the wearer's head and the mask against the wearer's face. An advantage of the invention is that, by tightening the straps, the wearer draws the helmet and mask toward each other against the wearer's head and face, so that the helmet and mask cooperate to maintain a secure fit for both mask and helmet.

Accordingly, it is an object of the present invention to provide an interface between a safety helmet and an SCBA face mask in which both the helmet and the face mask are suspended on a wearer's head by a single set of support straps, thereby eliminating the need for separate support assemblies; a helmet and face mask suspension system in which the helmet and face mask are drawn together to seat both securely against the wearer's head and face; a helmet and face mask system in which the mask is received against movement horizontally and vertically by a single strap on either side of the mark; and a helmet and face mask system which is more comfortable and is easier to don and doff in a hazardous or emergency situation and which is relatively inexpensive to fabricate.

Other objects and advantages will be apparent from the following description, the accompanying drawings and the appended claims.

DETAILED DESCRIPTION

Figure 1:
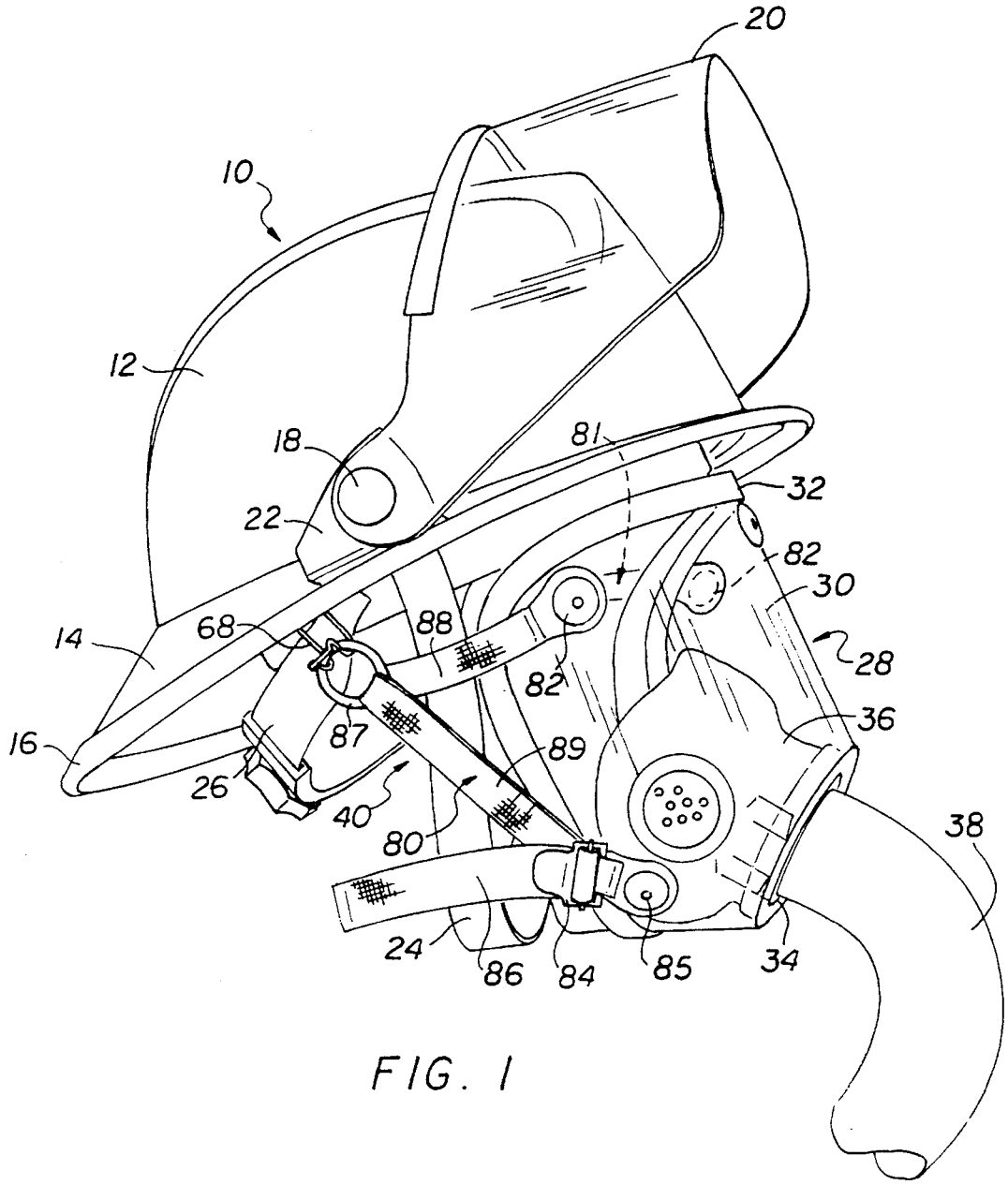
FIG. 1 is a side perspective view of the helmet and face mask interface system of the present invention.

FIG. 1 shows a preferred embodiment of the safety helmet and face mask interface system according to the present invention. The safety helmet, which in the preferred embodiment is a firefighter helmet, generally designated 10, includes a rigid outer shell 12 and a brim portion 14 which extends about the lower periphery of the shell. A lip 16 extends about the periphery of the brim 14. A polycarbonate face shield 20 is pivotally attached on each side of the shell 12 by rivets 18 attached to brackets 22 which are mounted on the shell 14 (only one bracket is shown). The helmet 10 further includes a two-piece chin strap 23, 24 bolted to the brim 14 by brackets 25 and an adjustable strap 26 to secure the helmet on the wearer's head.

A self-contained breathing apparatus ("SCBA") face mask, generally designated 28, is located at the front of the helmet 10. The mask 28 includes a transparent, polycarbonate face plate 30 and a flexible gasket 32 which extends about the periphery of the face plate 30 to provide a comfortable fit against the wearer's face. The mask 28 further includes an opening 34 for connecting a mouthpiece 36 to a hose 38 connected to an oxygen tank (not shown). When in use, the mask 28 extends from just below the brim of the helmet around the face of the wearer to protect the eyes, nose and mouth of the wearer from hazards in the environment. SCBA masks 28 of the construction described thus far are well-known in the firefighting field as a means to provide air or oxygen to a firefighter in a smoke or fume-filled environment.

Figure 2:
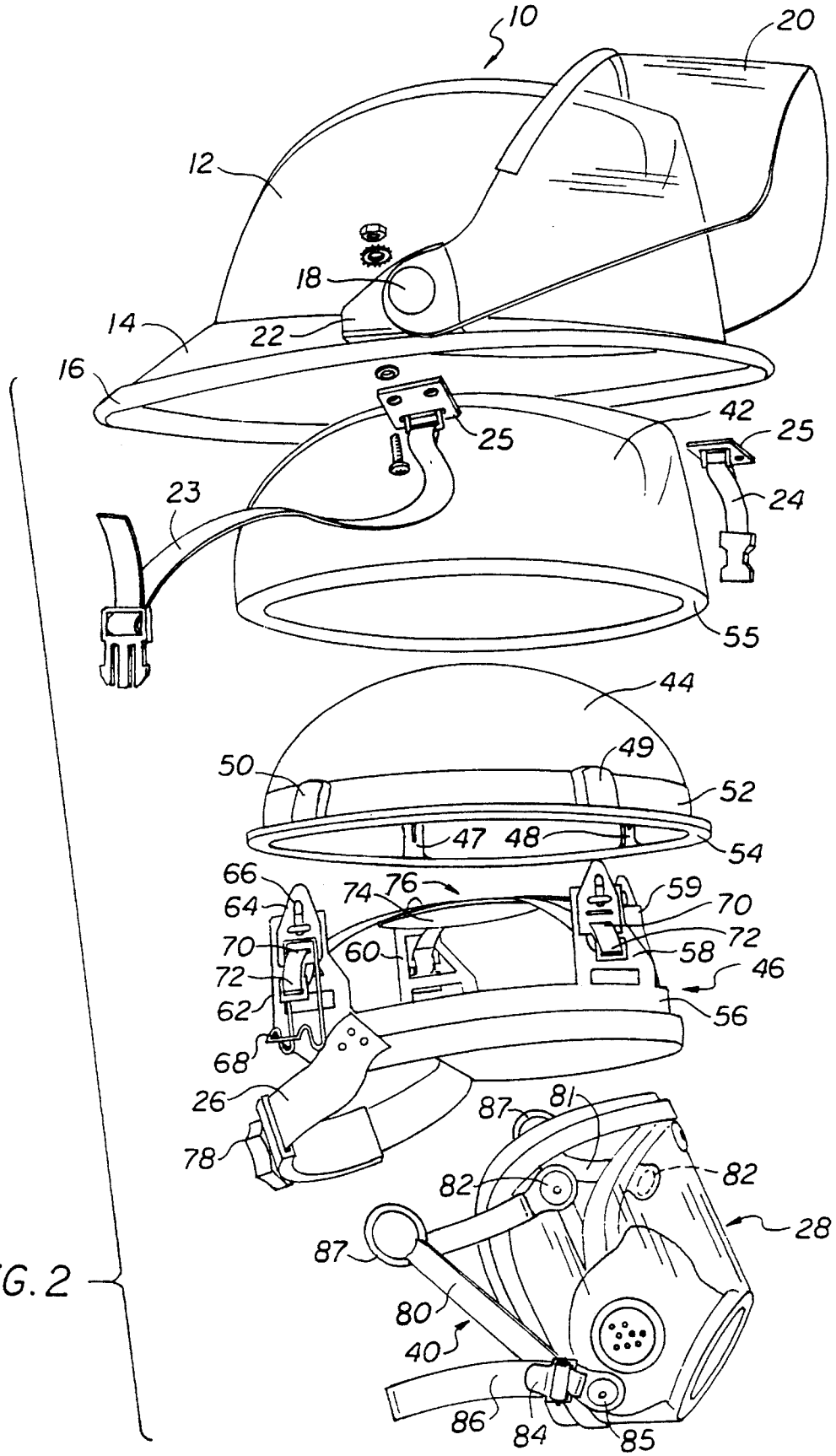
FIG. 2 is an exploded perspective view of the system shown in FIG. 1.

A strap assembly, generally designated 40, interconnects the helmet and the face mask, as will be described in more detail below. As shown in FIG. 2, the helmet 10 includes a liner which is composed of a foam insert 42, a cap 44 and an adjustable headband assembly 46. The foam insert 42 is of the same general shape as the shell 12 for fitting snugly therein. The cap 44 is generally dome-shaped and extends about the interior of the insert 42. The cap 44 is made of a rigid plastic material to provide support for the liner. Four bosses 47, 48, 49, 50 are formed in and are spaced about the cap 44 and a peripheral recess 52 extends about the base of the cap. A flange 54 projects outwardly from and extends around the bottom periphery of the recess 52. The flange 54 lies against the bottom edge 55 of the insert 42 when the liner is assembled in the helmet.

The headband assembly 46 includes a band 56 and four tab extensions 58, 59, 60, and 62 spaced about the periphery of the band 56. Each of the extensions 58–62 includes a clip member 64 having a slot 66 therein engages a clip (not shown) in a corresponding one of the bosses 47–50, with which the clip members 64 are aligned, to suspend the headband assembly 46 within the cap 44.

In the preferred embodiment, the strap assembly 40 includes hook means such as wire hooks 68 which are attached to clip members 64 of tab extensions 60, 62 on the left and right rear sides of the headband 46. The hooks 68 are preferably a double S-shaped loop of piano wire. The hooks 68 are attached at their upper portions to their respective clip members 64 and extend downwardly therefrom, below the bottom edge of the liner. Each of the tab extensions 58, 59, 60 and 62 also includes a slot 70 having a web strip 72 disposed therein. Each of the web strips 72 extend from the extensions 58, 59, 60 and 62 to a center pad 74 to form webbing 76. The webbing 76 is spaced from the internal upper surface of the cap 44, and is shaped to fit over a firefighter's head. The retaining strap 26 is connected to the band 56 and extends downwardly toward the rear of the helmet. The retaining strap 26 includes knob 78 for adjusting the effective length of the strap 26, and therefore its tension on the wearer's head.

As further shown in FIG. 2, the strap assembly 40 includes a face mask 28 and straps 80, 81 made of heat-resistant material attached to both sides of the mask at upper and lower points. The straps 80, 81 are each attached by pivot connections 82 to the upper portion of the mask 28 and are looped through buckles 84 attached to the lower portion of the mask by pivot connections 85 (only one of which is shown). Straps 80, 81 are threaded through their respective buckles 84 leaving trailing ends 86 (only end 86 of strap 80 being shown). Metal O-rings 87 are slidably retained on the straps 80, 81 between the pivots 82 and the buckles 84.

As shown in FIG. 1, mask 28 is supported horizontally by segments 88 of straps 80, 81, which extend from O-rings 87 to pivots 82, and are supported vertically be segments 89 extending from the O-rings to buckles and pivots 84, 85. Thus, for each side of the mask, two points of support are provided by single strap.

Figure 3:
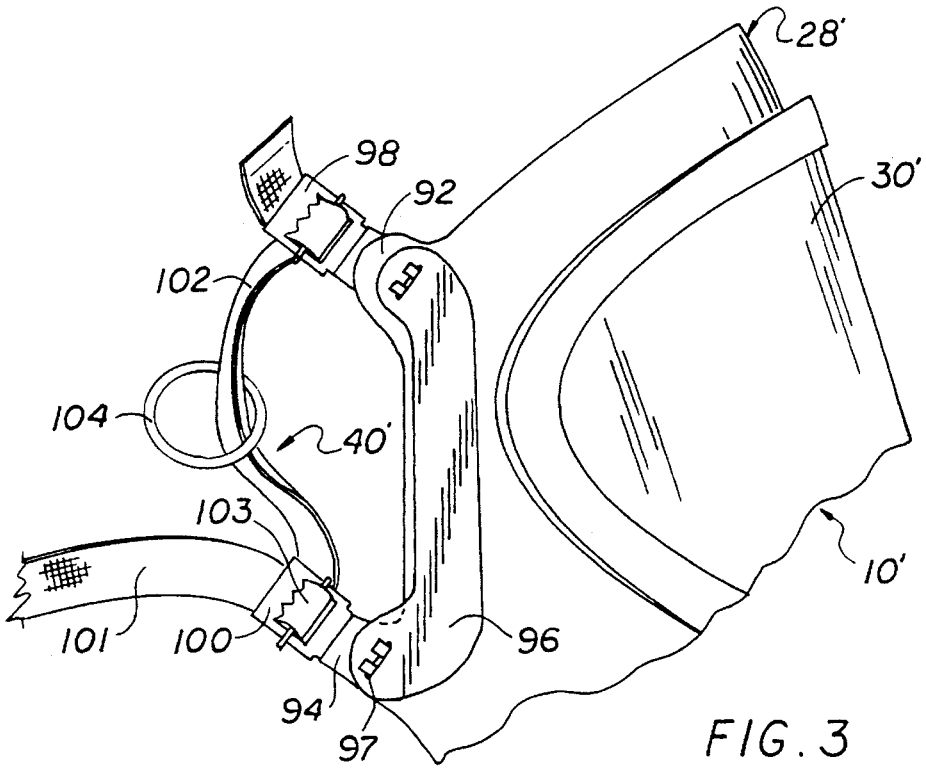
FIG. 3 is a detail side elevation showing the interface of the invention utilizing an alternate face mask embodiment.

FIG. 3 shows an alternate embodiment of the mask 28' of the present invention. With this embodiment, the face plate 30' is reduced in size, and the gasket 32' is thicker and made of a flexible, heat resistant material such as neoprene, and engages and conforms to the firefighter's face. Upper and lower lobes 92, 94 extend from each side of the mask, although only one side of the mask is shown in the FIG. 3. The strap assembly 40' includes a rigid stiffening plate 96 which extends along the edge of the mask between the lobes 92, 94, to prevent excessive distortion of the mask 28'. Square-lock buckles 98, 100 are attached to the mask at lobes 92, 94 and are secured to the ends of plates 96 by metal clasps 97. A pair of straps 102 are threaded between the fasteners 98, 100, on each side of the mask 28' (only one of which is shown), and trailing ends 101 of each strap extend beyond the buckles 100. Each of the buckles 98, 100 includes a sawtooth edge 103 for gripping the strap 102 and preventing the strap from sliding within the fastener. O-rings 104 are slidably mounted on the straps 102 (only one of which is shown) and slide along the straps between the fasteners 98, 100.

Figure 4:
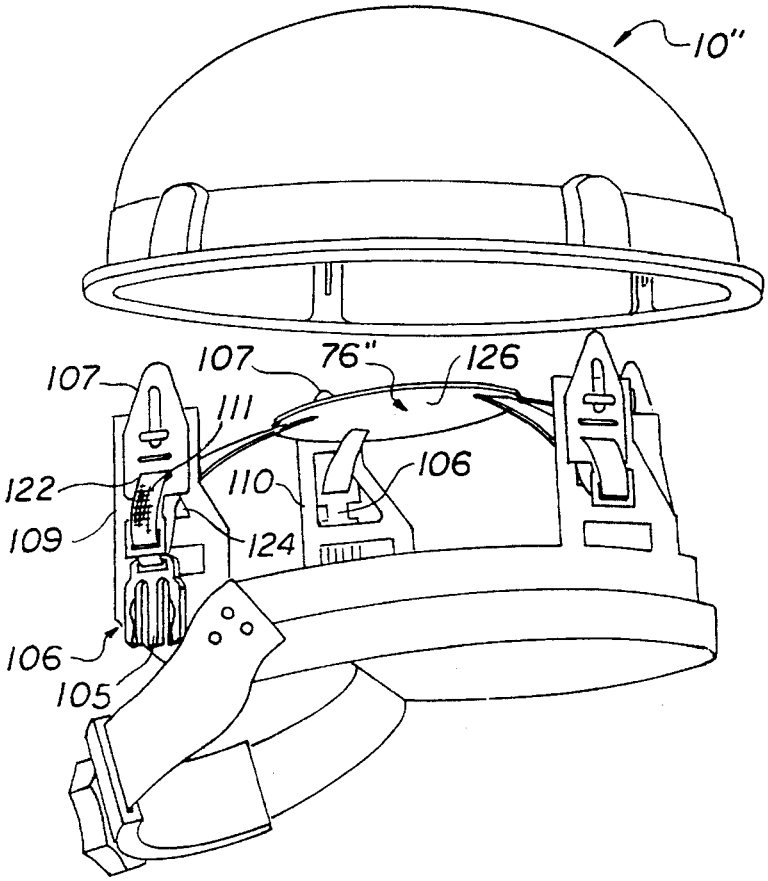
FIG. 4 is an exploded perspective view of a helmet liner showing an alternate embodiment of the invention for the connection mechanism of the interface.
Figure 5:
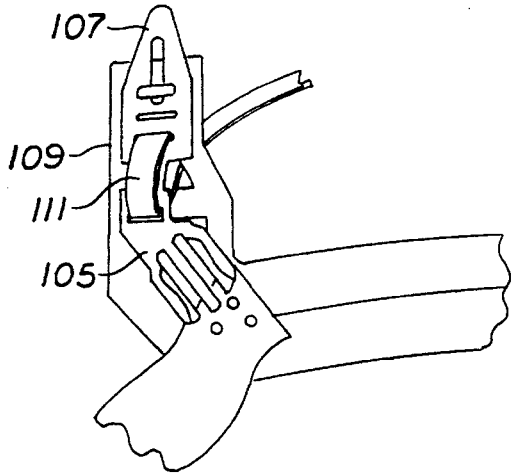
FIG. 5 is a detailed side elevation of the male connector element of FIG. 4.
Figure 7:
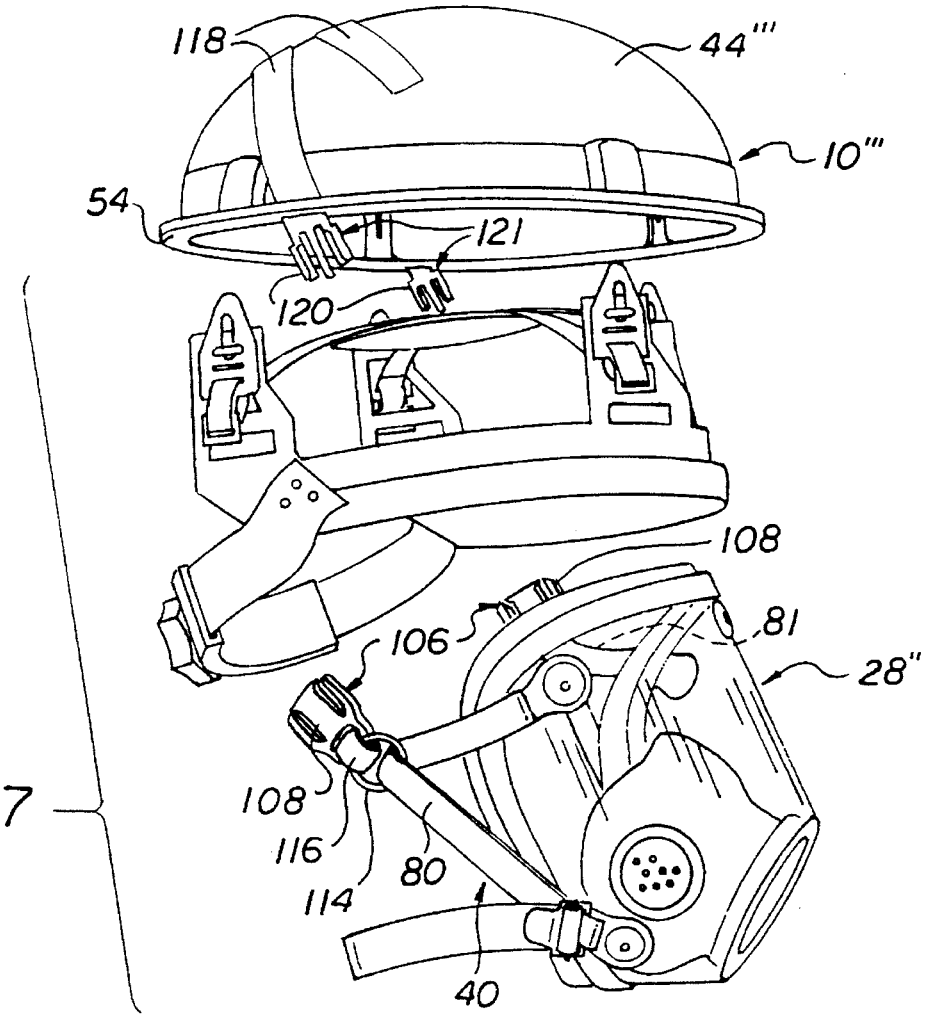
FIG. 7 is an exploded perspective view illustrating the alternate embodiment of FIG. 4.

In a second alternate embodiment of the helmet 10" shown in FIGS. 4 and 5, male components 105 of releasable male-female connectors 106 are attached to the rear tab extensions 109, 110 by web strips 111. The web strips 111 pass through slots 122, 124 formed in the extensions 109, 110 and clip members 107, and extend from the tab extensions to a center pad 126 to form part of the cradle 76" of the helmet. Male component 105 of helmet 10" is shown in greater detail in FIG. 5. With helmet 10", the female components 108 of the male-female connectors 106 are attached to O-rings 114 which are slidably retained on straps 80, 81 mounted on the mask 28" as shown in FIG. 7. The female connector 108 is attached to the O-ring 114 by web strip 116. A second O-ring is located on the other side of the mask and is mounted on strap 81, but is not shown in the drawing.

In a third alternate embodiment of the helmet 10'" shown in FIG. 7, the strap assembly 40" includes a pair of straps 118 which are oriented in criss-cross fashion and are adhesively attached to the exterior of the cap 44'". Each strap 118 extends through the rim 54 on opposite sides of the cap 44'" and terminates in a male component 120 of male-female releasable connectors 121. The female components 108 of the releasable connectors 121 are mounted on the O-rings 114 on the mask 28" by web strip 116, as described previously. Accordingly, mask 28" is attachable both to helmet 10" in FIG. 4 and to helmet to 10'" in FIG. 7.

The operation of the face mask and helmet interface system is shown generally in FIG. 6 and is as follows. The firefighter first dons the helmet 10'" on his head so that the cradle 76 (see FIG. 2) engages the top of his head. The retaining strap 26 is adjusted to span the back of the firefighter's head for a snug fit, and the chin strap segments 23, 24 are fastened together and drawn snugly under the firefighter's chin to secure the helmet 10'". Although helmet 10'" is shown in FIG. 6, it is to be understood that this procedure is substantially the same for helmets 10, 10' and 10".

After the helmet is in position, the wearer places the mask 28" over his face and, for the preferred embodiment shown in FIG. 1, the strap assembly 40 is engaged by looping the O-rings 87 over the hooks 68 on the sides of the helmet. With the O-rings corrected to the hooks, the helmet 10 and mask 28 are both suspended on the wearer's head by the headband assembly 46 and webbing 76 in the helmet. When in this configuration, the helmet 10 and mask 28 can be adjusted or tightened on the wearer's head by pulling the ends 86 of the straps 80, 81.

Figure 6:
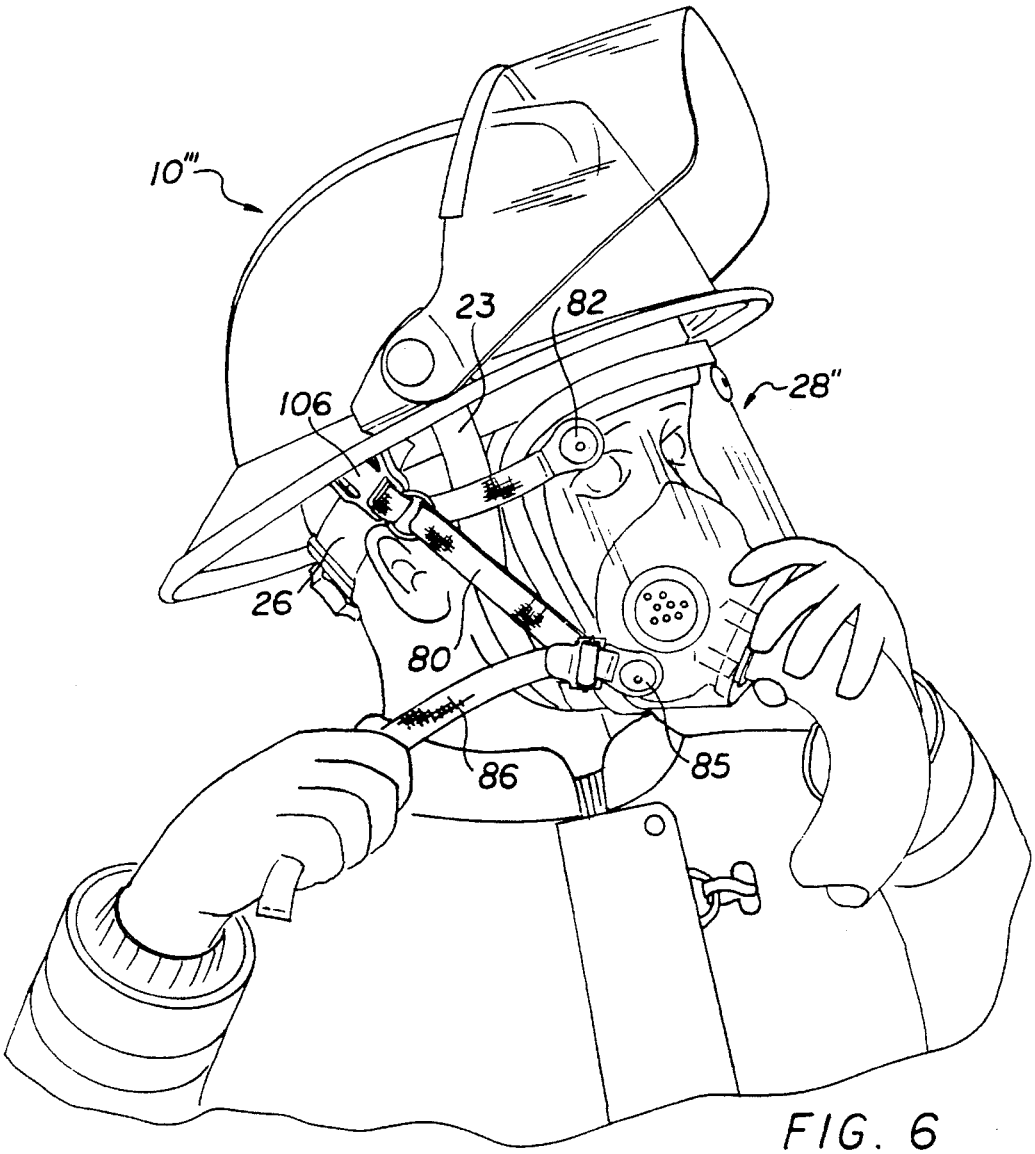
FIG. 6 is a perspective view illustrating a helmet and face mask positioned upon the head of a wearer utilizing the interface of the present invention.

As shown in FIG. 6, the wearer may tighten the mask 28" by holding the mask with the left hand and pulling the end 86 of strap 80 with the right hand; then reversing, holding the mask 28" with the right hand and pulling the end 86 of the strap 81 with the left hand. Alternately, the wearer can position the mask 28" over his face, then simultaneously grasp the ends 86 of straps 80, 81 with his right and left hands and pull the ends away from the mask. By pulling the ends 86 in either fashion (sequentially or simultaneously), the result is that the effective lengths of the straps 80, 81 between upper and lower pivot connections 82, 85 is shortened. This shortening acts to draw the mask 28" and the helmet 10"' toward each other, securely seating the mask and helmet on the wearer simultaneously.

To release the mask 28" from the face of the wearer, one or both of the connectors 106 on either side of the mask may be disconnected. If the time of release is to be somewhat temporary, only a single connector 106 is disconnected, which allows the mask 28" to dangle away from the face of the wearer by the remaining connected connector 106. With the preferred embodiment of FIGS. 1 and 2, release of the mask 28 is even easier: the rings 87 are removed from the hooks 68 on either side of the helmet 10 for complete removal of the mask from the helmet, or alternately, one of the rings 87 is removed from its associated hook 68 (for example, the hook 87 on strap 80), which allows the mask to dangle free of the face of the wearer, held by the engagement of hook 68 and ring 87 on the other strap (for example, strap 81).

While the forms of apparatus herein described constitute preferred embodiments of the invention, it is to be understood that the invention is not limited to these precise forms of apparatus and that changes may be made therein without departing from the scope of the invention.

What is claimed is:

1. A helmet and face mask system comprising:

a helmet including a headband assembly for suspending said helmet on a head of a wearer, said headband assembly including an annular headband adapted to contact a wearer's head, a webbing diametrically attached to said headband, a first connector component attached to said headband at one rear side thereof, and a second connector component attached to said headband at an opposite rear side thereof;

a mask shaped to engage a face of said wearer; and means for attaching and drawing said mask to said first and second connector components such that an integral connection is formed between said mask and said headband assembly;

said attaching means holding both said helmet on said wearer's head and said mask against said wearer's face securely by drawing said mask and said headband assembly toward each other; and said attaching means including means for adjustably supporting said mask in a horizontal and vertical direction.

2. The system of claim 1 wherein said attaching means includes strap means for interconnecting said mask and said headband assembly, said strap means comprising said adjustable vertical and horizontal supporting means.

3. The system of claim 2 wherein said strap means includes third and fourth connector components, adapted to engage said first and second connector components, respectively, for releasably attaching said mask to said headband assembly.

4. The system of claim 3 wherein said strap means includes a first strap connected to said mask at first and second vertically-spaced points thereon, and said third connector component is attached to said first strap, whereby a segment of said first strap extending between said third connector component and said first point comprises said horizontal supporting means; and a second segment of said first strap extending between said third connector component and said second point comprises said vertical supporting means.

5. The system of claim 4 wherein said third connector component is slidably attached to said first strap between said first and second points.

6. The system of claim 7 wherein said first strap is adjustably connected to said mask at one of said first and second points, so that a wearer can adjust a length of said first strap extending between said first and second points, whereby horizontal and vertical forces exerted by said strap means that correspondingly hold said helmet on said wearer's head and said mask against said wearer's face are varied.

7. The system of claim 6 wherein said strap means includes a second strap connected to said mask at third and fourth points thereon, and said fourth connector component is slidably attached to said second strap.

8. The system of claim 7 wherein said second strap is adjustably connected to said mask at one of said third and fourth points, so that a wearer can adjust a length of said second strap extending between said third and fourth points, whereby horizontal and vertical forces exerted by said strap means that correspondingly hold said helmet on said wearer's head and said mask against said wearer's face are varied.

9. The system of claim 8 wherein said first and second connector components include hook means, and said third and fourth connector components include O-ring means slidably mounted on said first and second straps respectively.

10. The system of claim 8 wherein said first and second connection points are positioned on a side of said mask, and said third and fourth connection points are positioned on an opposite side of said mask from said first and second points.

11. The system of claim 10 wherein said second and fourth points are positioned on said mask below said first and third points, and said first and second straps each include adjustable buckle means at said second and fourth points, said adjustable buckle means enabling manual adjustment of said lengths of said first and second straps by a wearer.

12. The system of claim 3 wherein said strap means includes a first strap connected to said mask by first and second fasteners thereon, and said third connector means component is slidably attached to said first strap between said first and second fasteners.

13. The system of claim 12 wherein said strap means includes a second strap connected to said mask by third and fourth fasteners thereon, and said fourth connector means component is also slidably attached to said second strap.

14. The system of claim 13 wherein an effective length of said first strap is adjustable between said first and second fasteners, and an effective length of said second strap is adjustable between said third and fourth fasteners, so that said wearer can adjust said lengths of said first and second straps extending between said fasteners, whereby horizontal and vertical forces exerted by said strap means that correspondingly hold said helmet on said wearer's head and said mask against said wearer's face are varied.

15. The system of claim 14 wherein said third and fourth connector components each include O-ring means slidably mounted on said first and second straps, respectively.

16. The system of claim 15 wherein said first and second connector components each include hook means for connecting to said O-ring means.

17. The system of claim 13 wherein said first and second fasteners are positioned on a side of said mask, and said third and fourth fasteners are positioned on an opposite side of said mask from said first and second fasteners, a first plate is attached to said mask and interconnects said first and second fasteners, and a second plate is attached to said mask and interconnects said third and fourth fasteners, said first and second plates preventing said mask from distorting in response to forces exerted by said strap means.

18. The system of claim 1 wherein said helmet is a firefighter's helmet.

19. A helmet and face mask system comprising:

a helmet including a shell and a liner disposed in said shell, said liner including a cap enclosing a headband for suspending said helmet on a wearer's head, said headband having first and second hooks located on opposite sides of said headband;

a face mask shaped to engage a face of a wearer;

a first strap connected to a side of said mask at first and second points thereon;

a second strap connected to said mask at third and fourth points thereon, said third and fourth points being located on an opposite side of said mask from said first and second points, each of said first and second straps including an O-ring slidably attached between said first and second, and said third and fourth points, each of said O-rings being releasably engagable with one of said hooks, for releasably interconnecting said mask and said helmet; and said straps further including adjustable buckle means at said second and fourth points for enabling manual adjustment of effective lengths of said straps between said points by said wearer, whereby a force exerted by said strap means to hold said helmet on a head of a wearer and said mask against a face of a wearer is varied.

20. A helmet and face mask system comprising:

a helmet including a shell and a liner disposed in said shell, said liner including a cap enclosing a headband for suspending said helmet on a wearer's head, said headband having first and second hooks means, located on opposite sides of said headband;

face mask means shaped to engage a face of a wearer;

first strap means connected to a side of said mask by first and second fasteners located thereon;

second strap means mounted on an opposite side of said mask from said first strap means, said second strap means being connected to said mask by third and fourth fastener means mounted thereon, each of said first and second strap means including O-ring means slidably attached between said fastener means each of said O-ring means being engagable with a different one of said hook means for releasably interconnecting said mask and said helmet; and said strap means being adjustable between said fasteners for enabling manual adjustment of an effective length of said strap means by said wearer, thereby adjusting a force exerted by said strap means to hold said helmet on a head of a wearer and said mask against a face of a wearer.

21. A safety helmet and face mask system comprising:

a helmet including a shell and a liner disposed in said shell;

a webbing assembly disposed in said helmet, said webbing assembly including an annular headband adapted to contact a wearer's head and a webbing diametrically attached to said headband, said webbing assembly being adapted to fit a wearer's head and said webbing assembly suspending said helmet above said wearer's head;

a face mask shaped to engage a face of a wearer;

a first adjustable strap attached to a first side of said mask for providing vertical and horizontal support to said mask;

a second strap attached to an opposite side of said mask;

a first fastener for releasably coupling said first strap to said headband of said webbing assembly on a first side of said helmet; and a second fastener for coupling said second strap to said headband of said webbing assembly on an opposite side of said helmet.

22. The system of claim 21, wherein:

said first strap is connected to said first side of said mask at first and second points thereon, and a said second strap is connected to said opposite side of said mask at third and fourth points thereon;

said first fastener comprises first and a second fastener components and one of said first and second fastener components is slidably attached to said first strap, between said first and second points; and the other one of said first and second fastener components is attached to said webbing assembly.

23. A helmet and face mask system comprising:

a helmet including a shell and a liner disposed in said shell;

a mask shaped to engage a face of a wearer; and means for attaching and drawing said mask to said helmet such that an integral connection is formed between said mask and said helmet, whereby said attaching means holds both said helmet on a wearer's head and said mask against a wearer's face, said attaching means including means for supporting said mask in a horizontal direction, and means for supporting said mask in a vertical direction;

said attaching means includes strap means for interconnecting said mask and said helmet, said strap means comprising said vertical and horizontal supporting means;

said strap means includes connector means for releasably attaching said mask to said helmet; and said helmet includes a cap enclosing a headband for suspending said helmet on a wearer's head, and said strap means is attached to said cap.

24. A safety helmet and face mask system comprising:

a helmet including a shell and a liner disposed in said shell;

a webbing assembly disposed in said helmet, said webbing assembly including an annular headband and a webbing diametrically attached to said headband, said webbing assembly being adapted to fit a wearer's head and said webbing assembly suspends said helmet above said wearer's head;

a face mask shaped to engage a face of a wearer;

a first adjustable strap attached to a first side of said mask for providing vertical and horizontal support to said mask;

a second strap attached to an opposite side of said mask;

a first connector for releasably coupling said first strap to said webbing assembly on a first side of said helmet; and a second connector for coupling said second strap to said webbing assembly on an opposite side of said helmet;

said first strap is connected to said first side of said mask at first and second points thereon, and a said second strap is connected to said opposite side of said mask at third and fourth points thereon;

said first connector comprises first and a second connector components and one of said first and second connector components is slidably attached to said first strap, between said first and second points; and the other one of said first and second connector components is attached to said webbing assembly.

25. A helmet and face mask system comprising:

a helmet including a headband assembly for suspending said helmet on a head of a wearer, said headband assembly including an annular headband having two tab extensions located on opposite rear sides of said headband, a webbing diametrically attached to said headband, a first connector component attached to a first one of said tab extensions, and a second connector component attached to a second one of said tab extensions;

a mask shaped to engage a face of said wearer; and means for attaching and drawing said mask to said first and second connector components such that an integral connection is formed between said mask and said headband assembly;

said attaching means holding both said helmet on said wearer's head and said mask against said wearer's face securely by drawing said mask and said headband assembly toward each other; and said attaching means including means for adjustably supporting said mask in a horizontal and vertical direction.

26. The system of claim 25 wherein:

said helmet includes a shell and a liner disposed in said shell;

said liner includes a cap enclosing said headband; and each said tab extensions include a clip member for attaching said headband assembly within said cap.

27. The system of claim 26 wherein said attaching means includes strap means for interconnecting said mask and said headband assembly, said strap means comprising said adjustable vertical and horizontal supporting means.

28. The system of claim 27 wherein said strap means includes third and fourth connector components, adapted to engage with said first and second connector components respectively, for releasably attaching said mask to said headband assembly.

29. The system of claim 28 wherein said strap means includes:

a first strap connected to said mask by first and second fasteners thereon, and said third connector component is slidably attached to said first strap between said first and second fasteners; and a second strap connected to said mask by third and fourth fasteners thereon, and said fourth connector component is slidably attached to said second strap between said third and fourth fasteners.

* * * * *